US009609994B2

(12) United States Patent
Young

(10) Patent No.: US 9,609,994 B2
(45) Date of Patent: Apr. 4, 2017

(54) CLEANING APPARATUS FOR CLEANING MOP MATERIAL AND METHOD OF CLEANING MOP MATERIAL

(76) Inventor: Ronald Alexander (Scot) Young, Stourbridge (GB)

( * ) Notice: Subject to any disclaimer, the term of this patent is extended or adjusted under 35 U.S.C. 154(b) by 1149 days.

(21) Appl. No.: 13/697,356

(22) PCT Filed: Apr. 28, 2011

(86) PCT No.: PCT/GB2011/050852

§ 371 (c)(1),
(2), (4) Date: Nov. 11, 2012

(87) PCT Pub. No.: WO2011/148155

PCT Pub. Date: Dec. 1, 2011

(65) Prior Publication Data

US 2013/0056027 A1 Mar. 7, 2013

(30) Foreign Application Priority Data

May 12, 2010 (GB) ..... 1007927.5

(51) Int. Cl.
*A47L 13/60* (2006.01)
*A47L 13/59* (2006.01)
*F26B 5/14* (2006.01)

(52) U.S. Cl.
CPC ..... *A47L 13/60* (2013.01); *A47L 13/59* (2013.01); *F26B 5/14* (2013.01)

(58) Field of Classification Search
None
See application file for complete search history.

(56) References Cited

U.S. PATENT DOCUMENTS 2,147,782 A 2/1939 Abbott
3,411,175 A * 11/1968 Mills ..... A47L 13/502 15/311

(Continued)

FOREIGN PATENT DOCUMENTS

DE 2227554 A1 12/1973
EP 1374752 A2 1/2004
JP 2007098099 A 4/2007

OTHER PUBLICATIONS

WO 2011/135289 A3, International Search Report.

*Primary Examiner* — Michael Kornakov
*Assistant Examiner* — Ryan Coleman
(74) *Attorney, Agent, or Firm* — Thedford I. Hitaffer; Hitaffer & Hitaffer, PLLC

(57) ABSTRACT

A cleaning device (14) for cleaning mop material (33) which freely hangs from a holder (31,32), having an opening (15) in which the hanging mop material (33) is receivable, including a pair of bristle carrying parts (22, 24), each of the bristle carrying parts (22, 24) being rotatable about a respective axis (22*a*, 24*a*) by at least one motive device in opposite senses of direction such as to draw the hanging mop material (33) between the bristle carrying parts (22, 24), whereby bristles carried by the bristle carrying parts (22, 24) engage the mop material, and a method of cleaning mop material which freely hangs from a holder, using the cleaning device (14), the method including resisting the drawing-in of the mop material between the bristle carrying parts (22, 24), so that the bristles act on and brush the mop material.

19 Claims, 4 Drawing Sheets

(56) References Cited

U.S. PATENT DOCUMENTS

| | | | | |
|---|---|---|---|---|
| 6,042,656 | A * | 3/2000 | Knutson | A47L 7/0009 134/21 |
| 2003/0209255 | A1* | 11/2003 | Brown | H01L 21/67075 134/1.1 |
| 2010/0122428 | A1* | 5/2010 | Williamson | A47L 5/365 15/347 |

* cited by examiner

CLEANING APPARATUS FOR CLEANING MOP MATERIAL AND METHOD OF CLEANING MOP MATERIAL

This application, filed under 35 USC 371, is a United States National Stage Application of International Application No. PCT/GB2011/050852, filed Apr. 28, 2011, which claims priority to UK Application No. 1007927.5.5, filed on May 12, 2010, the disclosures of which are incorporated herein by reference.

DESCRIPTION OF INVENTION

This invention relates to a cleaning apparatus for cleaning mop material and to a method of cleaning mop material, particularly, but not exclusively, to a method of cleaning mop material which is, or is made at least predominantly of microfibre material.

The use of microfibre material cloths and the like for cleaning and drying has brought considerable advantages in the cleaning industry, as such materials readily take up dirt particles and retain them, leading to a reduced level of dirt particles and bacteria remaining on a surface, such as a floor, which is cleaned. Particularly in hospital environments the use of microfibre mop material has proved very useful in the fight against patient infection.

However, microfibre materials are also reluctant to release dirt particles which are taken up. Whereas a traditional mop material can be rinsed e.g. in a bucket of cleaning fluid to remove dirt particles, rinsing of microfibre materials is far less effective at removing dirt particles from the material.

To ensure that bacteria present in dirt particles is not spread by a heavily soiled microfibre material mop for example, on a floor, operational guidelines provide for a maximum microfibre mop material usage before the microfibre mop material is replaced with fresh mop material. The used microfibre mop material is then subject to thorough laundering, in a washing machine before re-using, but even then, all dirt particles may not be removed from the microfibre material.

According to a first aspect of the invention I provide a cleaning device for cleaning mop material which freely depends from a holder, the cleaning device having a opening in which the freely depending mop material is receivable, characterised in that the cleaning device includes a pair of bristle carrying parts each carrying a plurality of bristles, each of the bristle carrying parts being rotatable about a respective axis of rotation by at least one motive device, the bristle carrying parts being rotatable in opposite senses of direction such as to draw the hanging mop material introduced into the opening, between the bristle carrying parts, whereby bristles carried by the bristle carrying parts engage the mop material.

It has been found that by brushing the mop material rather than simply rinsing it, can considerably lengthen the usability of the mop material before it may require laundering. The brushes with bristles provides for dirt particles to be more efficiently removed from the mop material than can be achieved by rinsing. Irrespective of the nature of the mop material it is recognised that subjecting the mop material to brushing with bristles may shorten the life of the mop material, but the present invention provides a solution which is effective in economic terms, taking into account the capital and operational costs of at least more frequent laundering e.g. microfibre mop material.

The opening of the cleaning device may be generally upwardly facing. This facilitates the insertion of the mop material into the cleaning device by simply holding the mop holder generally above the opening, and lowering the mop material towards the bristle carrying parts. Preferably, the opening narrows towards the bristle carrying parts, so as to guide the mop material towards the bristle carrying parts.

The cleaning device may include a receptacle which is positioned to receive cleaning fluid and dirt removed from the mop material during cleaning of the mop material by the bristle carrying parts. The receptacle is advantageously positioned beneath the bristle carrying parts so that liquid which is removed from the mop material during cleaning is able to flow under gravity into the receptacle.

The cleaning device may be attachable to a mop bucket having a volume for liquid and an open upper end. It is envisaged that the cleaning device can be used by cleaning operators in the vicinity of the floor or other surface undergoing cleaning, to carry out cleaning of mop material.

The receptacle of the cleaning device may be separate from the volumes for liquid of the mop bucket, so as to keep clean cleaning fluid separate from dirty cleaning fluid and dirt particles removed from the mop material by the bristle carrying parts.

The bristle carrying parts may be substantially cylindrical rollers, the axis of rotation of each roller being positioned substantially centrally of the roller.

The axes of rotation of the bristle carrying parts may be positioned substantially parallel with one another.

The spacing between the rotation axes of the bristle carrying parts may be narrow enough to enable both bristle carrying parts to engage the mop material simultaneously, but not so narrow as to perform a wringing action on the mop material during cleaning of the mop material.

The position of at least one of the bristle carrying parts may be adjustable between a first position in which the mop material may be introduced to the cleaning device without contacting the bristles, and a second position in which the bristles contact the mop material. For example the bristle carrying parts may be relatively adjusted towards and away from one another.

Each of the bristle carrying parts may be rotatable by a respective motive device.

The cleaning device may include a wringer mechanism.

The wringer mechanism is preferably positioned such that cleaning fluid and dirt particles wrung from the mop material are receivable in the receptacle.

Operation of the wringer mechanism may cease the operation of the or each motive device of the bristle carrying parts.

Mop material which freely depends from a collapsible flat mop may be receivable in the opening.

According to a second aspect of the invention, there is provided a cleaning station which includes a combination of a bucket for cleaning fluid and a mop material cleaning device, characterised in that the cleaning device includes an opening for receiving mop material which freely depends from a holder, a plurality of bristles and at least one motive device to effect relative movement between the bristles and the mop material when the mop material engages the bristles, and further characterised in that the bucket and the mop material cleaning device are carried by a wheeled structure.

The bucket and the mop material cleaning device may be carried together on a single wheeled structure. The wheeled structure may be a dolly on which the receptacle and the mop cleaning device are mounted, or the receptacle may have a plurality of wheels attached to its base.

The mop material cleaning device may be connected to the bucket. In this embodiment, a single wheeled structure is provided, and the cleaning device is carried by the receptacle for cleaning fluid. Alternatively, the mop material cleaning device and the receptacle for cleaning fluid may each be carried by a respective wheeled structure, the wheeled structures being connectable together.

The cleaning station may include a cleaning device in accordance with the first aspect of the invention.

According to a third aspect of the invention, there is provided a method of cleaning mop material which freely depends from a holder, using a cleaning device, characterised in that the cleaning device includes an opening to receive freely depending mop material, a pair of bristle carrying parts each carrying a plurality of bristles, each of the bristle carrying parts being rotatable about a respective axis of rotation by at least one motive device, the bristle carrying parts being rotatable in opposite senses of direction, such as to draw the freely depending mop material introduced into the opening, between the bristle carrying parts, and further characterised in that the method includes rotating the bristle carrying parts in opposite senses of direction, and introducing mop material into the opening, such that the bristles carried by the bristle carrying parts engage the mop material, and resisting the drawing in of the mop material to between the rollers, so that the bristles act on and brush the mop material.

The method may include moving the mop material relative to the cleaning device so that the bristles of the cleaning device contact different portions of the mop material. Thus a large proportion and preferably nearly all of the mop material, or at least the mop material which in use contacts the surface to be cleaned, can be subjected to brushing and hence cleaning.

The method may include rinsing the mop material in cleaning fluid prior to, during or subsequent to brushing the mop material with the bristles, and collecting dirty cleaning fluid and/or dirt particles removed from the mop material by the bristles in a receptacle adjacent the bristle carrying parts.

The method is a wet method inasmuch as the mop material is wet and the receptacle is positioned so as to receive cleaning liquid and dirt particles from the mop material as the mop material is brushed.

Embodiments of the invention will now be described with reference to the accompanying drawings in which:—

FIG. 1 is an illustrative perspective view from the front and side of a cleaning apparatus including a cleaning device of the first aspect of the invention;

FIG. 1*a* is an illustrative view of a mop with material for cleaning in an 'in use' condition;

FIG. 1*b* is an illustrative view of the mop of FIG. 1*a*, but in a collapsed condition;

Figure 1:
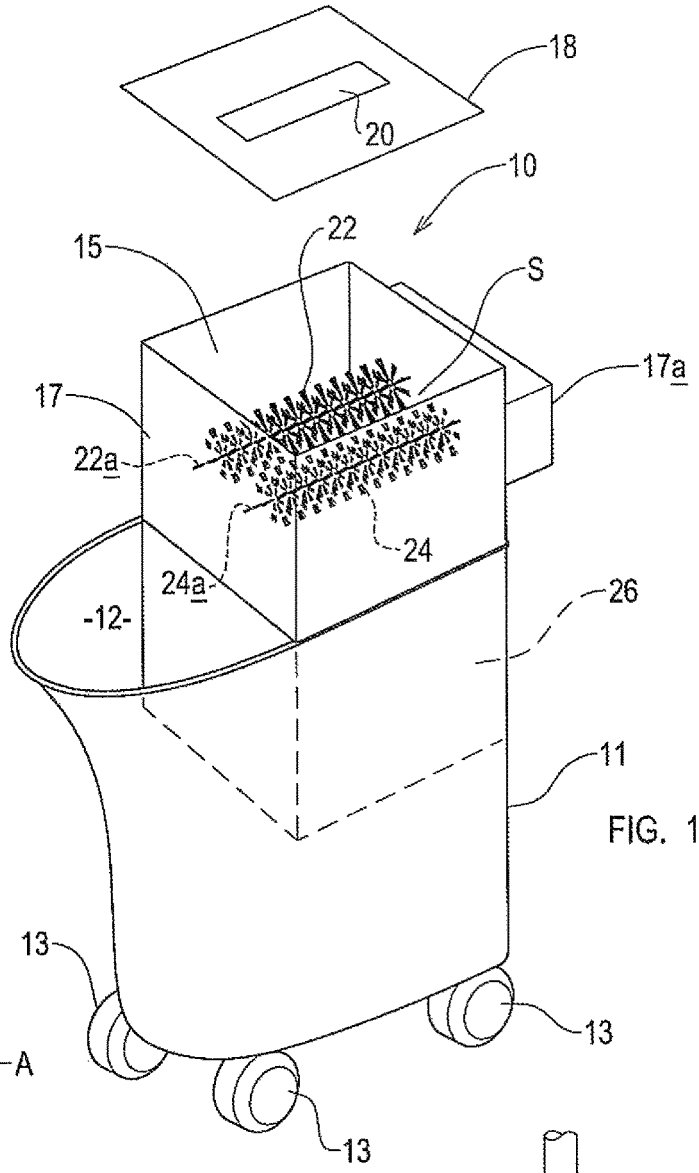
Figure 3A:
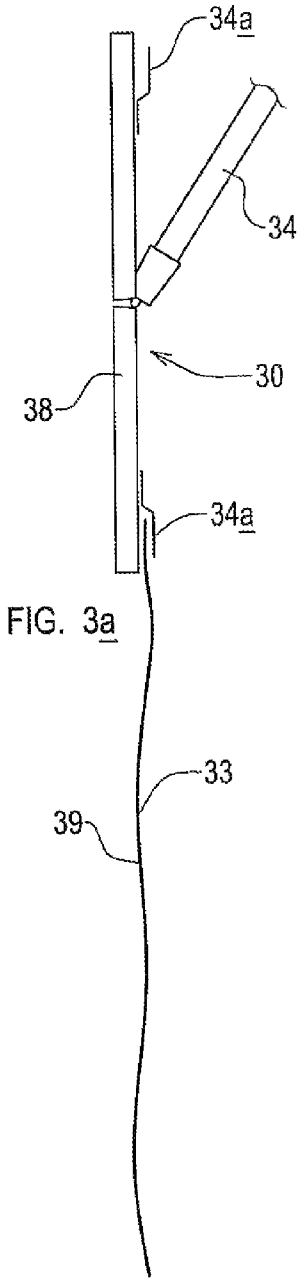
FIG. 3 is an illustrative side view of an alternative cleaning apparatus in use.
Figure 4:
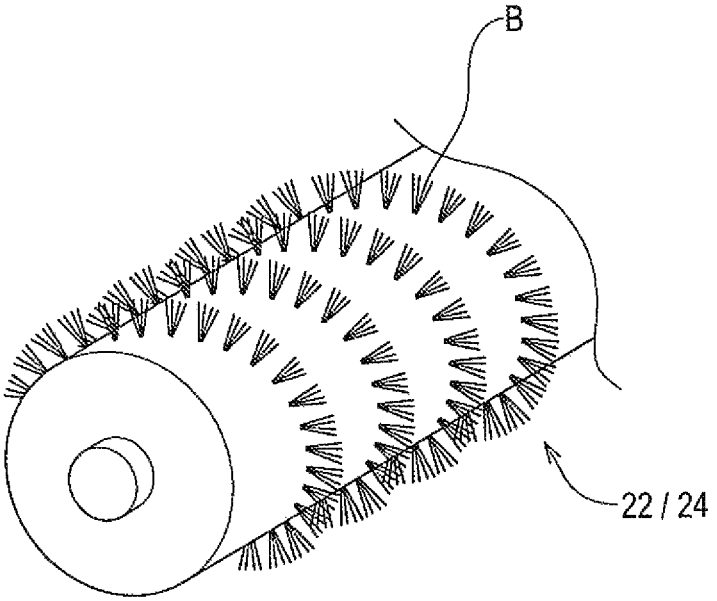
Figure 5:
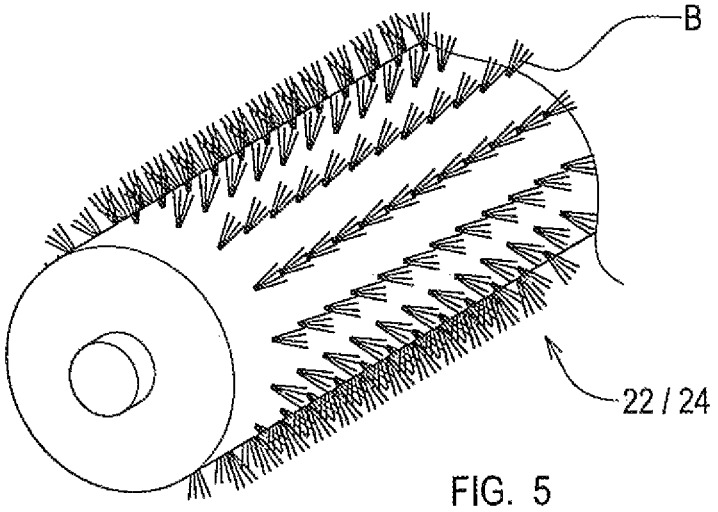
Figure 6:
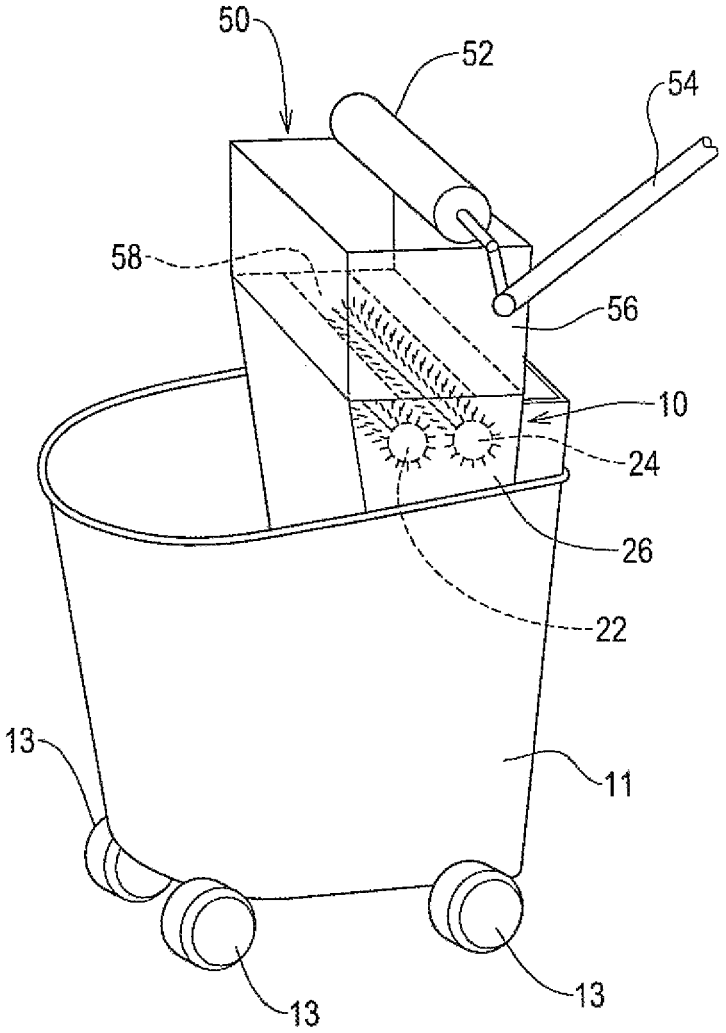

FIG. 3*a* is an illustrative side view of another kind of mop with mop material for cleaning;

FIG. 4 is a fragmentary view of part of a roller of the apparatus of FIG. 1;

FIG. 5 is a view similar to FIG. 4 but of an alternative embodiment; and FIG. 6 shows a cleaning apparatus which includes the cleaning device of the first aspect of the invention and a wringer apparatus.

Referring first to FIG. 1, a cleaning apparatus 10 is shown which includes a receptacle 11 in the form of a bucket with an internal volume to receive and retain cleaning/rinsing liquid, and an open upper end 12. The bucket 11 includes a plurality of wheels 13, although these are optional. The cleaning apparatus 10 further includes a cleaning device 14 which in this particular example is mounted on the bucket 11, being retained relative to the open upper end 12 of the bucket 11. Clamps (not shown) are provided on at least one of the bucket 11 and the cleaning device 14, so as to hold the cleaning device 14 substantially stationary relative to the bucket 11.

In use the bucket 11 contains a volume of liquid such as water which may contain chemical additive as required. The cleaning device 14 does not obscure the entire open upper end 12 of the bucket 11, but an operator may for example, rinse or fill mop material of a mop with the liquid by immersing the mop material into the liquid from the open upper end 12 of the bucket 11.

Within the housing 17 are a pair of bristle carrying parts 22, 24 which in this example are rollers with external bristles, which rollers 22, 24 are rotatable individually about respective rotational axes 22*a*, 24*a*. The rollers 22, 24 are in parallel, and slightly spaced apart to provide a space S to which mop material may be introduced.

The rollers 22, 24 are contra rotated in use about their respective axes 22*a*, 24*a*, towards one another i.e. so that mop material in the space S tends to be drawn downwardly further into the housing 17. After a cleaning operation as described below, the rollers 22, 24 may be contra rotated oppositely to the direction of rotation during cleaning, to facilitate release and removal of mop material from the cleaning device 14.

In this embodiment, the positions of the rollers 22, 24 or rather of their axes 22*a*, 24*a* of rotation, relative to the remainder of the cleaning device 14 are fixed. The rollers 22, 24 are rotated by respective electric motors mounted on the housing 17 e.g. in a housing part indicated at 17*a*. The cleaning apparatus 10 may include its own battery power supply e.g. provided beneath the bucket 11. The or each battery may be re-chargeable, charging being effected by connecting the power supply to a mains power supply whilst attached to the cleaning apparatus, or the or each battery being detachable from the cleaning apparatus 10 and replaceable. In the latter case, the battery may be clipped on to the cleaning apparatus 10. Alternatively, the cleaning apparatus may be mains powered.

A proximity switch is preferably provided near to the opening 15 of the cleaning device 14, so as to cause the rollers 22, 24 to rotate when cleaning material is inserted into the opening 15. The switch preferably includes a Hall effect sensor, and a mop head to which the mop material to be cleaned is attached includes a magnet. This inhibits inadvertent operation of the rollers 22, 24 by insertion of an item other than mop material.

Alternatively, a manual switch (not shown), to cause the rollers 22, 24 to rotate may be provided on the housing 17 of the cleaning device 14 or there may be a foot operated switch, as required.

The rollers 22, 24 may be directly driven from a single motor (gearing would be required to effect contra rotation of the rollers 22, 24), or via a belt or other transmission as required.

A controller is preferably provided to control the operation of the motor(s), and may effect a cleaning "programme" upon activation of the cleaning device 14.

The housing 17 of the cleaning device 14 also includes a receptacle 26 for receiving liquid and/or dirt particles removed from the mop material during cleaning. The receptacle 26 extends into the bucket 11, but is preferably not fluidly communicable with the volume of the bucket to retain dirty cleaning fluid separate from clean cleaning fluid. Alternatively, a filtering device may be provided to clean the cleaning fluid which enters the receptacle 26 before being returned to the bucket 11. This reduces the need to refill the bucket 11 regularly.

Figure 2:
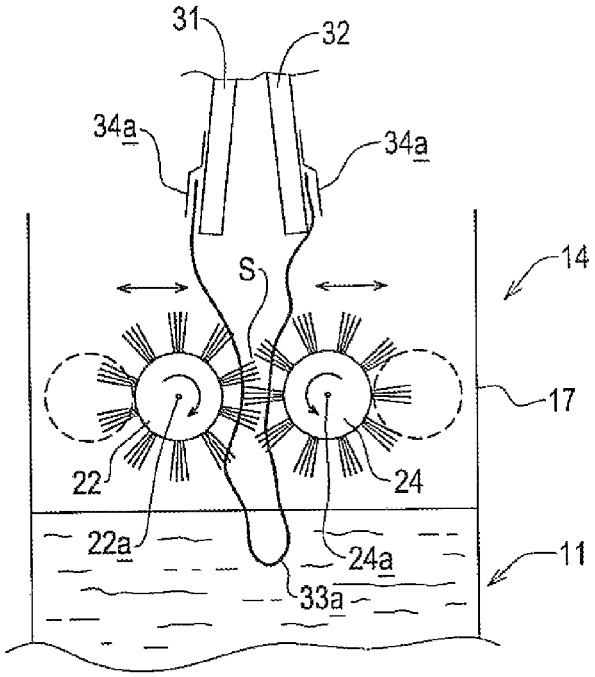
FIG. 2 is an illustrative cross-sectional view of the cleaning apparatus of FIG. 1, in use cleaning mop material.

Referring now to FIG. 2, similar parts of the cleaning apparatus 10 to those of FIG. 1 are given the same references. This embodiment is similar in many respects to the cleaning apparatus 10 of FIG. 1, but in this example, the rollers 22, 24 are not in fixed positions relative to the remainder of the cleaning device 14. Rather in FIG. 2, the two rollers 22, 24 are mounted to be movable relative to the remainder of the cleaning device 14, towards and away from one another to adjust the space S between them. In the example, the rollers 22, 24 are movable laterally towards and away from one another by a foot operated lever device in which there is a spring or the like to bias the rollers 22, 24 together.

When the rollers 22, 24 are moved apart against the bias to the positions indicated in dotted lines, mop material may be introduced into the space S between the rollers 22, 24 without the bristles of the rollers 22, 24 contacting the mop material, and when the rollers 22, 24 are permitted to move towards one another, the bristles contact the mop material.

In another example, only one of the rollers 22, 24 may be movable relative to the other to effect relative movement towards and away from one another. The or each of the movable rollers 22, 24 may be moved by a motive device such as a motor together and/or apart, or by some alternative mechanism to the foot pedal operated arrangement described.

Figure 1B:
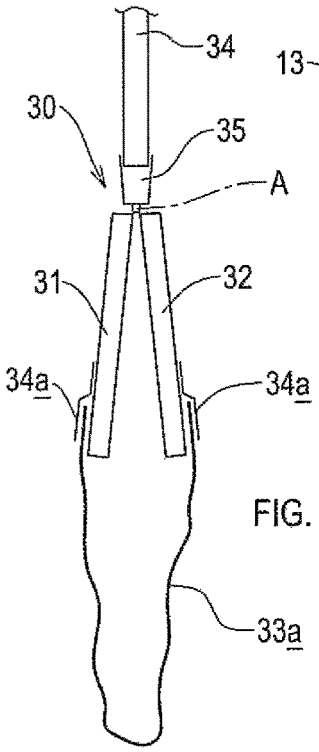
Figure 1A:
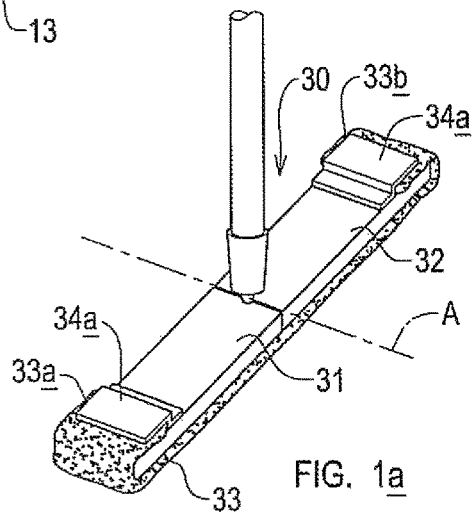

Referring now to FIGS. 1*a* and 1*b*, the cleaning apparatus 10 described so far has been designed particularly for cleaning microfibre mop material of a flat mop 30 of the kind which includes a pair of mop parts 31, 32 which may be pivoted relative to one another about a folding axis A, between an in-use condition (see FIG. 1*a*) and a folded or collapsed condition (see FIG. 1*b*). In the in-use condition, the mop parts 31, 32 are generally contiguous, with the mop material 33 being a pad, ends 33*a*, 33*b* of which are each retained by a retainer dip 34*a* of each mop part 31, 32, so that the mop material pad 33 extends beneath the mop parts 31, 32 where in use it contacts a floor or other surface to be cleaned by the mop 30.

In the folded condition as shown in FIG. 1*b*, the mop parts 31, 32 are folded about the folding axis A which is adjacent where a mop handle 34 is secured in a socket 35 which is pivotable about the folding axis A, relative to each of the mop parts 31, 32 in this example. In the FIG. 1*b* folded condition the mop material pad 33 depends in a loop 33*a* from the folded mop parts 31, 32.

Whereas in the example of the mop 30 of FIGS. 1*a* and 1*b*, the handle 34 is movable relative to the mop parts 31, 32 about the one folding axis A only in use, in another example there may be a universal joint with the socket 35 movable about two mutually perpendicular axes as required to facilitate usage of the mop 30 in cleaning a floor or other surface.

To effect cleaning of the microfibre mop material of the pad 33, the mop 30 is folded or collapsed as shown in FIG. 1*b* to provide the loop 33*a* of depending mop material. The material of the loop 33*a* may be rinsed in the liquid in the bucket 11 as required, but is introduced into the opening 15 of the cleaning device 14 through slot 20 in the lid 18 of the housing 17, into the space S between the rollers 22, 24, for cleaning.

Desirably, at the same time, the rollers 22, 24 are contra rotated as described above, so that the mop material loop 33*a* is drawn further into the housing 14 as the bristles of the rollers 22, 24 contact the mop material.

For the FIG. 2 embodiment, the positions of the rollers 22, 24 may first be adjusted by being relatively laterally moved apart to widen the space S, to facilitate introducing mop material to between the pair of rollers 22, 24. The rollers 22, 24 may be stationary or rotating as required as this is done. When the operator is ready to effect cleaning of the mop material, the rollers 22, 24 may be moved together and contra rotated. The ability to adjust the space S of between the rollers 22, 24 is advantageous if the bristles on the rollers 22, 24 have become worn or deformed in which case the space S can be reduced in size to ensure that the bristles contact the mop material to effect cleaning during a cleaning operation. Such adjustability is also advantageous in the event that different types of mop material are required to be cleaned. The most appropriate space S for the type of material to be cleaned may be selected.

To prevent the mop material of the pad 33 simply being fed downwards in the space S by the action of the bristles of the contra rotating rollers 22, 24, in which case there may be no or minimal relative movement between the bristles and the mop material necessary to effect brushing, the mop material desirably is held still by the operator so that the bristles of the rollers 22, 24 may brush dirt particles from the adjacent portion of the microfibre mop material pad 33. The mop material pad 33 may be sequentially raised and lowered into the space S by the operator to bring different portions of the mop material into contact with the bristles of the contra rotating rollers 22, 24.

The torque applied to the rollers 22, 24 by the motor(s) is relatively small, such that items inadvertently engaging one or both of the rollers, e.g. a piece of clothing or a hand of a user, causes the rollers 22, 24 to cease rotating. If an item which is larger or thicker than mop material is introduced into the space S, the load on the motor(s) increases. The power of the motor(s) increases, and this increase is detected by the controller which causes the rollers 22, 24 to rotate in a direction opposite to that which draws material into the cleaning apparatus; so as to "eject" the thicker or larger items from the space S.

At the end of a cleaning operation, when an operator is satisfied that the entire pad 33 of the mop material has been subjected to sufficient brushing, the mop material may be removed from the cleaning device 14. It will be appreciated that this may be achieved by the operator simply pulling the mop material loop 33*a* from the cleaning device 14, or the rollers 22, 24 may be contra rotated in an opposite sense to that described for cleaning, to release the mop material, or for the FIG. 2 embodiment the positions of the rollers 22, 24 may be adjusted by being moved relatively laterally apart to release the mop material.

Preferably the controller carries out a cleaning program, which includes a first stage of contra-rotating the rollers 22, 24 in a first direction and a second stage of contra-rotating the rollers 22, 24 so as to "eject" the mop material from the rollers 22, 24. The first and second stages may be repeated as required. The program preferably lasts a predetermined length of time, so as to inhibit "over-cleaning" the mop material which tends to shorten battery life. The predetermined length of the cleaning program is preferably between 10 and 15 seconds, but may be shorter or longer than this.

The double roller 22, 24 embodiment described so far enables the mop material of the entire depending loop 33*a* of the mop material 33 to be cleaned without having to disassemble the mop material from the mop parts 31, 32, with the bristles of one 22 of the rollers 22, 24 brushing one half of the depending loop 33*a* of mop material and the bristles of the other roller 24 brushing the other half of the depending loop 33*a*.

The bristles of the rollers 22, 24 contacting the mop material 33 can provide a significant force and it may be difficult for an operator to hold and manipulate the mop 30 for most effective cleaning. In FIG. 3*a* modification is shown to facilitate cleaning operations. In this modification, the cleaning apparatus 10 includes a mop handle holder 40 with which the handle 34 of the mop 30 may be engaged to facilitate the operator holding the mop 30 during cleaning. The loop 33*a* of mop material may be moved up in the space S between the rollers 22, 24 by the operator exerting a downwards force on a part 36 of the mop handle 34 lying outwardly of the holding device 40, the holding device 40 acting as a fulcrum.

Figure 3:
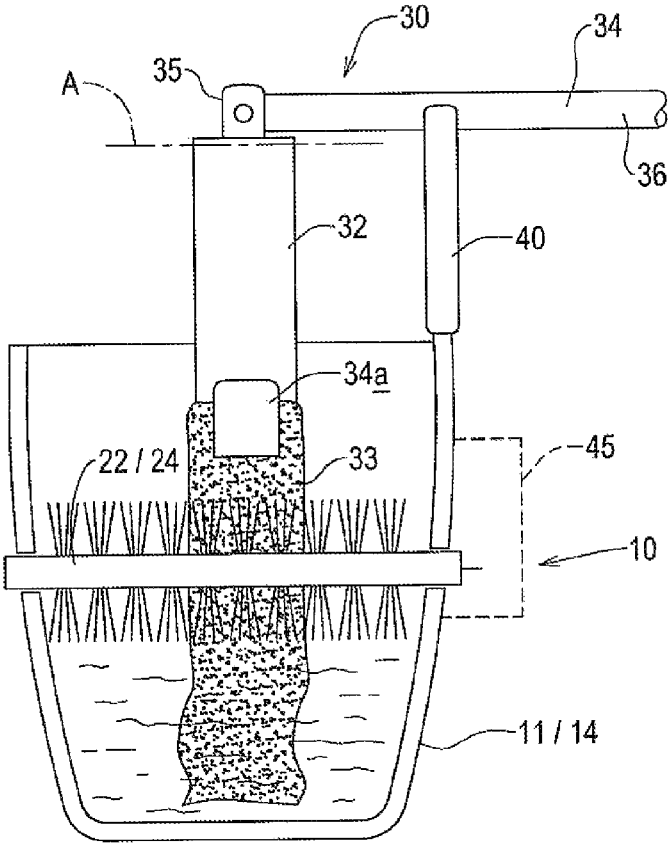

Another modification illustrated in FIG. 3 is that the cleaning device 14, instead of being mounted on the upper end of the bucket 11, is integral with the bucket 11 or other receptacle, with the rollers 22, 24 mounted in the volume of the bucket 11 at about the liquid level in the bucket 11, so that at least the bristles are at least partially immersed in the liquid. From FIG. 2 it can be seen that in that embodiment, the lower end only of the depending loop 33*a* of mop material beneath the rollers 22, 24 may be immersed in the liquid in the bucket 11, but in the FIG. 3 example, a much greater proportion of the depending loop 33*a* may be immersed. However in this embodiment the drive mechanism 45 for rotating the rollers 22, 24 may need to be mounted above the liquid level, or otherwise well isolated from the liquid in the bucket 11. Efficient seals would be required if the ends of the rollers 22, 24 pass through a wall of the bucket 11.

Typically the cleaning device 14 may be used in conjunction with a wringing apparatus for wringing out the wet mop material, as is known in the art.

A wringing apparatus 50 is shown in FIG. 6. In this embodiment, the wringing apparatus 50 is of a known type and includes a roller 52 which is movable by means of a lever 54 relative to a housing 56. When mop material is received in the housing 56, the roller 52 squeezes the mop material against the housing 56 such that liquid is wrung from the mop material. The housing 56 includes an outlet 58 which is adjacent the opening 15 of the cleaning device 14 such that when the roller 52 is in a first (unused) position, the mop material is able to pass through the outlet 58 of the wringer apparatus 50 into the opening 15 of the cleaning device 14.

Movement of the lever 54 to operate the wringer apparatus 50 automatically ceases operation of the motive device rotating the bristle carrying roller 22, 24, to avoid the mop material being drawn into the cleaning device 14 whilst the mop material is being wrung.

The position of the wringer apparatus 50 above the cleaning device 14 means that liquid and dirt particles wrung from the mop material are received in the receptacle 26. The liquid may then pass from the receptacle 26 back into the bucket 11, preferably being filtered or otherwise cleaned before being returned to the bucket 11.

Although only one type of wringer apparatus is shown, it will be appreciated that any type of wringer apparatus which is suitable for wringing mop material depending from a holder may be used in conjunction with the cleaning device 14.

In the FIG. 1 illustration, the cleaning device includes a housing 17 which includes an upper opening 15 in which the mop material to be cleaned is receivable. There is also provided a lid 18 (shown separated from the remainder of the cleaning device 14 in the example). The lid 18 includes a slot 20 to permit mop material to be introduced to the cleaning device 14 as described below. The lid 18 may be omitted, as required.

The mop 30 described with reference to FIGS. 1*a* and 1*b* and shown in FIGS. 2 and 3 is a particular kind of mop which is collapsible as described. In FIG. 3*a* there is shown a flat mop 30 in which there is a unitary mop head body 38 to which a pad 33 of mop material is attached by clips 34*a* in substantially the same fashion as with the folding mop parts 31, 32 of the mop 30 previously described.

To clean the mop material 33 of the mop 30, one of the mop material retainer clips 34*a* needs to be released so that the pad 33 of mop material depends from the mop head 38 as shown in FIG. 3*a*.

It will be appreciated that only one side i.e. the side of the mop material indicated at 39 will have been in contact with the floor and thus require cleaning. In any event the construction of the mop pad 33 may be such that the pad 33 only includes microfibre or other mop material on the one side 39 of the pad 33, with the opposite side being provided by a mounting web which does not need to be brushed clean.

In each event, only the one side 39 of the mop material requires cleaning and in this case, the cleaning device 14 need not have a pair of rollers 22, 24 or other bristle carrying parts. Instead, one of the rollers 22, 24 the roller which in use will contact the side of the pad 33 of mop material opposite to the side 39 to be cleaned, may be plain or at least may carry no bristles to provide a reaction surface. Alternatively the cleaning device 14 may only include a single movable, bristle carrying part 22 with the other roller 24 being replaced by a plain stationary, reaction surface such as a plate.

In an alternative embodiment, the pad 33 may be double sided as required.

In yet another embodiment (not shown) the bristle carrying part or parts 22, 24 need not be a, or a pair of rotatable rollers 22, 24, but a bristle carrying part may be provided by a part which in use is reciprocated rather than rotated in the housing 17 of the cleaning device 14, so that the bristles brush the mop material. The part may be made to be reciprocated by any desired mechanism, such as for examples only a motor and linear transmission, or a linear actuator. In each case during cleaning, the bristles of the bristle carrying part brush the dirt particles from the mop material.

In yet another example, there may be a stationary bristle carrying part in the cleaning device 14, with there being one or more rollers or other carrying devices which grab the mop material and move the mop material relative to the stationary bristle carrying part or parts, and/or the bristle carrying part or parts and the mop material may be movable in the housing 17 such as to effect brushing of the mop material.

Referring to FIG. 4 there is shown an example of a roller 22, 24 carrying bristles. The bristles B in the example are provided by tufts arranged along a generally helical path along the exterior of the roller 22, 24. In FIG. 5, the tufts of bristles extend axially of the roller. Many variations are possible.

The bristles B are short in the examples described above, being only a few millimeters long (for example, 10-20 mm long), and are relatively soft, but in another example the bristles B may be longer and stiffer. If the bristles are longer, the space S between the pair of rollers 22, 24 or other pair of relatively movable bristle carrying parts, or the bristle carrying part and reaction surface, may need to be greater. The distance between the rollers 22, 24 or other bristle B carrying parts or bristle carrying part and reaction surface may need to be adjusted for different thicknesses of pad 33 of mop material to be cleaned.

The bristles may be made of natural or synthetic material.

Although in each embodiment described the cleaning device 14 includes a lid 18 with a slot 20, to minimise the risk of an operator being injured by the rotating or otherwise moving bristle carrying part or parts 22, 24 of the apparatus 10, if there was a substantial depth from a top of the housing 17 to the rollers 22, 24 or other movable bristle carrying part or parts, a lid 18 such as that described may not be required.

If desired, the roller or rollers 22, 24 or other bristle carrying part or parts may be totally immersed in the liquid in the receptacle 11 rather than dry or partially immersed as in the examples described above.

Although the invention has been described in relation to the cleaning of mop material while the mop material 33 is still attached to the mop 30, in another example the invention may utilised to clean a pad of mop material, which may be separated from a mop 30 and may indeed even be usable otherwise than in relation to a mop 30 for mopping surfaces. Such mop material may be attached by a holding device by means of which an operator may introduce the mop material to the cleaning device 14 and manipulate the mop material while being acted upon by bristles of a cleaning device, or the holding device may hold the mop material without the operator needing to manipulate the mop material.

The cleaning device 14 need not be attached to a bucket or other mobile device. The cleaning device may be positioned adjacent a sink or a drain, to enable cleaning of mop material other than over a bucket. For example, mop material may be cleaned at the end of a shift, when the mop material is not sufficiently dirty to require full laundering.

Whilst the bucket 11 in FIG. 1 and FIG. 6 includes wheels 13, and the cleaning device 14 is attached to the bucket 11, the bucket 11 and the cleaning device 14 may alternatively be mounted on a wheeled structure such as a dolly. The cleaning device 14 may be mounted on a separate wheeled structure from the bucket 11, and the two wheeled structures may be connectable together.

The use of the term "wheels" or "wheeled" is intended to encompass castors, rollers or other ground-engaging apparatus which facilitates movement of the bucket 11 and/or cleaning device 14.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A cleaning device for cleaning mop material which freely depends from a holder, the cleaning device having an opening in which the freely depending mop material is receivable, characterised in that the cleaning device includes a pair of bristle carrying parts each carrying a plurality of bristles, each of the bristle carrying parts being rotatable about a respective axis of rotation by at least one motive device, the bristle carrying parts being rotatable in opposite senses of direction such as to draw the hanging mop material introduced into the opening, between the bristle carrying parts, whereby bristles carried by the bristle carrying parts engage the mop material, wherein the cleaning device further includes a wringer mechanism and the wringer mechanism is configured such that the operation of the wringer mechanism ceases the operation of the or each motive device of the bristle carrying parts.

2. A cleaning device according to claim 1 characterised in that the opening is generally upwardly facing.

3. A cleaning device according to claim 1 including a receptacle which is positioned to receive cleaning fluid and dirt removed from the mop material during cleaning of the mop material by the bristle carrying parts.

4. A cleaning device according to claim 1 which is attachable to a mop bucket having a volume for liquid and an open upper end.

5. A cleaning device according to claim 4 characterised in that a receptacle of the cleaning device is separate from a cleaning fluid holding part of the mop bucket, so as to keep clean cleaning fluid separate from dirty cleaning fluid and dirt particles removed from the mop material by the bristle carrying parts.

6. A cleaning device according to claim 1 characterised in that the bristle carrying parts are substantially cylindrical rollers, the axis of rotation of each roller being positioned substantially centrally of the roller.

7. A cleaning device according to claim 1 wherein the axes of rotation of the bristle carrying parts are positioned substantially parallel with one another.

8. A cleaning device according to claim 1 wherein the spacing between the rotation axes of the bristle carrying parts is narrow enough to enable both bristle carrying parts to engage the mop material simultaneously, but not so narrow as to perform a wringing action on the mop material during cleaning of the mop material.

9. A cleaning device according to claim 1 characterised in that the position of at least one of the bristle carrying parts is adjustable between a first position in which the mop material may be introduced to the cleaning apparatus without contacting the bristles, and a second position in which the bristles contact the mop material.

10. A cleaning device according to claim 1 characterised in that each of the bristle carrying parts is rotatable by a respective motive device.

11. A cleaning device according to claim 3, wherein the wringer mechanism is positioned such that cleaning fluid and dirt particles wrung from the mop material are receivable in the receptacle.

12. A cleaning device according to claim 1 characterised in that mop material which freely depends from a collapsible flat mop is receivable in the opening.

13. A cleaning station which includes a combination of a bucket for cleaning fluid and a mop material cleaning device according to claim 1.

14. A cleaning station according to claim 13 characterised in that the bucket and the mop material cleaning device are carried together on a single wheeled structure.

15. A cleaning station according to claim 14 characterised in that the mop material cleaning device is connected to the bucket.

16. A cleaning station according to claim 13 characterised in that the mop material cleaning device and the bucket are each carried by a respective wheeled structure, the wheeled structures being connectable together.

17. A method of using a mop, the mop including mop materially which freely depends from a holder, and the method including cleaning the mop material using a cleaning device, characterized in that the cleaning device includes an opening to receive freely depending mop material, a pair of bristle carrying parts each carrying a plurality of bristles, each of the bristles carrying parts being rotatable about a respective axis of rotation by at least one motive device, the bristle carrying parts being rotatable in opposite senses of directions, such as to draw the freely depending mop material introduced into the opening, between the bristle carrying parts, the cleaning device further including a wringer mechanism and further characterized in that the method includes:

wringing the mop material using the wringer mechanism; and brushing the mop material by rotating the bristle carrying parts in opposite senses of direction, introducing mop material into the opening, such that the bristles carried by the bristle carrying parts engage the mop material, and resisting the drawing in of the mop material to between the rollers, so that the bristles act on and brush the mop material, the method being further characterized in that operation of the wringer mechanism ceases the operation of the or each motive device of the bristle carrying parts.

18. A method according to claim 17 characterised in that the brushing step includes moving the mop material relative to the cleaning device so that the bristles of the cleaning device contact different portions of the mop material.

19. A method according to claim 17 characterised in that the method further includes rinsing the mop material in cleaning fluid prior to, during or subsequent to brushing the mop material with the bristles, and collecting dirty cleaning fluid and/or dirt particles removed from the mop material by the bristles in a receptacle adjacent the bristle carrying parts.

* * * * *